US005651142A

United States Patent [19]

del Valle Mas

[11] Patent Number: 5,651,142

[45] Date of Patent: Jul. 29, 1997

[54] SOCK WITH AN INTEGRAL POCKET

[76] Inventor: Maria E. del Valle Mas, 13030 SW. 75 Ave., Miami, Fla. 33156

[21] Appl. No.: 634,109

[22] Filed: Apr. 17, 1996

[51] Int. Cl.[6] ..... A41B 13/00

[52] U.S. Cl. ..... 2/239; 2/247

[58] Field of Search ..... 2/239, 247, 61, 2/242, 254, 249, 250, 251

[56] References Cited

U.S. PATENT DOCUMENTS

| | | | |
|---|---|---|---|
| 1,452,517 | 4/1923 | Lepow | 2/239 |
| 2,890,461 | 6/1959 | Hartman et al. | 2/247 |
| 4,373,215 | 2/1983 | Guigley | 2/239 |
| 4,445,233 | 5/1984 | Rubin | 2/247 X |
| 4,961,235 | 10/1990 | Williger | 2/247 X |
| 5,133,091 | 7/1992 | del Valle Mas | 2/247 X |
| 5,157,791 | 10/1992 | Woodson et al. | 2/239 |

*Primary Examiner*—C. D. Crowder
*Assistant Examiner*—Shirra L. Jenkins
*Attorney, Agent, or Firm*—J. Sanchellima

[57] ABSTRACT

A sock with sole, body and inner tube portions, the latter extending from the peripheral end of the body portion. The inner tube portion is made out of a lining that is thinner than the rest of the sock. The inner tube portion is folded and received entirely within the body portion of the sock. Stitching lines keep both layers of the folded inner tube attached to each other and to the body portion with at least one interruption along the end of the inner tube that is substantially aligned with the opening of the sock. Separate compartments are defined by longitudinally stitching both layers and to the body portion. Each compartment may be provided with an aperture to insert the objects to be carried by a user.

8 Claims, 1 Drawing Sheet

SOCK WITH AN INTEGRAL POCKET

BACKGROUND OF THE INVENTION

1. Field of the Invention

The present invention relates to a sock having a built-in pocket, and more particularly, to the type that has a pocket integrally knitted therein and the method to manufacture said sock.

2. Description of the Related Art

Applicant believes that the closest reference corresponds to U.S. Pat. No. 5,133,091 issued to the applicant in 1992. However, it differs from the present invention because it requires additional costly secondary operations (bottom seam 54, cutting opening 28) in the manufacture of the sock. Also, the use of securing means is not necessary since the stretching of the pocket maintains the stored articles substantially in place. The claimed present invention overcomes these shortcomings of the patented invention.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a sock that has a pocket integrally knitted therein so that a user can carry concealed articles such as keys cards, coins, and/or other items, which are stored in the pocket.

It is another object of this invention to provide a rapid and easy method of manufacturing the pocket inside the sock that is compatible with today's production methods and/or manufacturing equipment capabilities.

It is yet another object of this invention to provide such a sock with a pocket that is cost effective to manufacture while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
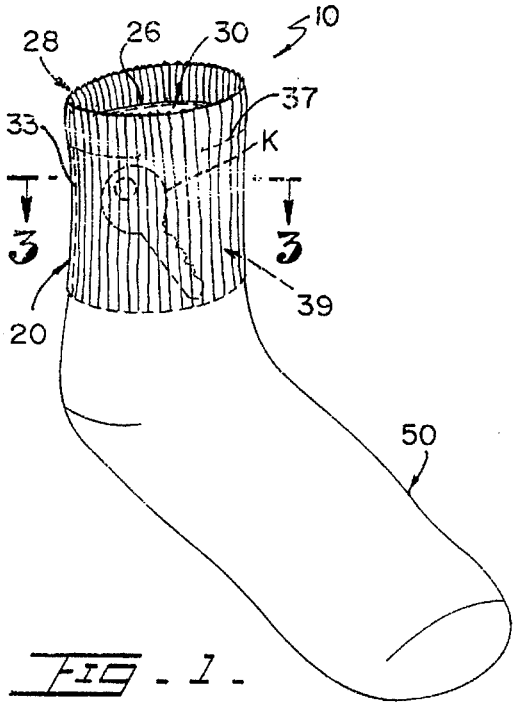
FIG. 1 represents an isometric view of a sock incorporating the present invention, showing a key housed in its pocket.
Figure 3:
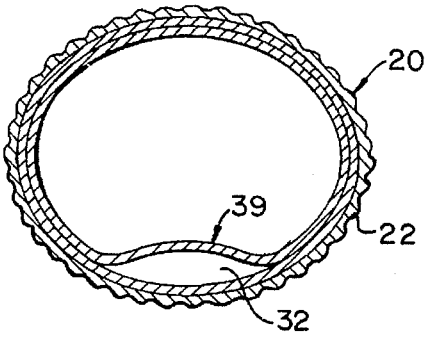
FIG. 3 is a cross section taken along line 3—3 of the upper body portion of the sock shown in FIG. 1.

Referring now to the drawings, where the present invention is generally referred to with numeral 10, it can be observed that it basically includes sock body portion 20, inner tube lining member 30 and sole portion 50. The inner tube lining member 30 further having a first end and a second end.

Figure 2:
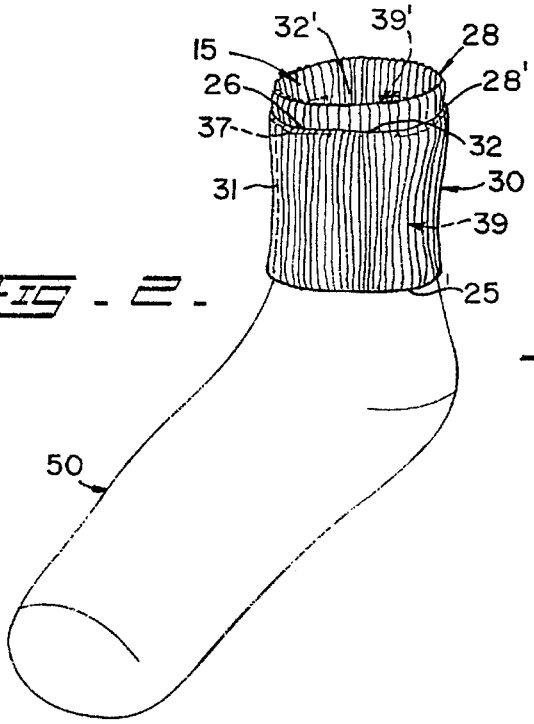
FIG. 2 is an isometric view of a sock similar to the one shown in FIG. 1 but inside out and also incorporating two pockets instead of one.
Figure 4:
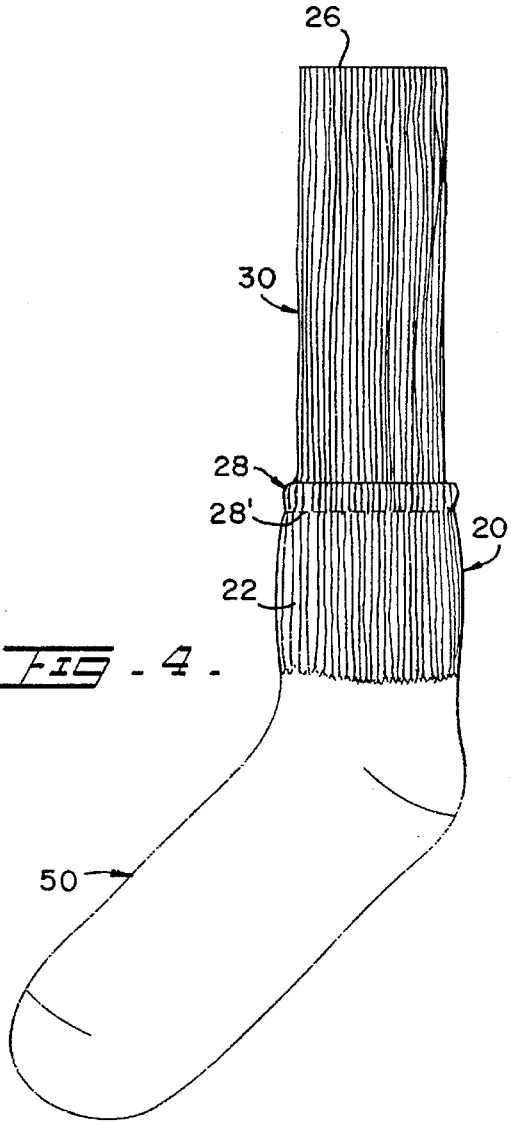
FIG. 4 is a representation of the distended sock lining without the secondary sewing operation.

Body portion 20 includes cuff portion 22 with an upper peripheral end, that may include finished turn welt 28 defining sock opening 15, in the preferred embodiment, after folding in member 30 as shown in FIGS. 1 and 2. Inner tube lining member 30 is knitted after turn welt 28, in the first step in the present invention of the manufacturing process, as seen in FIG. 4. Turn welt 28 is a conventional procedure in sock knitting manufacturing processes that provides a termination for the sock. The only secondary production step involves inserting inner tube lining member 30 within body portion 20 with edge 26 substantially aligned with lower edge 28' of turn welt 28, as best seen in the embodiment represented in FIG. 2. The objective being to conceal edge 26. Bottom fold 25 is formed where lining member 30 is folded which corresponds to substantially the longitudinal middle of inner tube lining member 30. Folded lining member 30 is stitched together along stitching lines 31 and 33 thereby forming two compartments 39 and 39', in the preferred embodiments, as been seen in FIGS. 1 and 2. Aperture 32 is formed by the interruption of upper peripheral stitching 37, as seen in FIG. 1. In FIG. 2, an additional aperture 32' is defined similar to aperture 32 in order to be able to use compartment 39'. Different articles, such as key K, can be stored within compartments 39 and 39'.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sock comprising:

A) a sole portion;

B) a body portion extending from said sole portion and said body portion having a peripheral end; and C) an inner tube member having first and second ends, said first end extending from said peripheral end and said inner tube member being folded along its longitudinal middle and being received within said body portion in overlapping relationship thereto and said second end being affixed to said body portion in substantial alignment with said peripheral end so that with at least one aperture is provided to insert and remove items to and from said folded inner tube member.

2. The sock set forth in claim 1 wherein said inner tube member is made out of a material that is thinner than the material of said body and sole portion.

3. The sock set forth in claim 2 wherein said folded inner tube member is affixed to said body portion along two separate spaced apart lines thereby defining two separate compartments within said folded inner tube member.

4. The sock set forth in claim 3 wherein each of said compartments includes an aperture.

5. A method of manufacturing a sock having a sole and body portions and an opening and said body portion including a peripheral end, and further including at least one internal compartment, comprising the steps of:

A) forming an inner tube portion with first and second ends and said first end extending from said peripheral end; and B) folding said extended inner tube portion along its longitudinal middle and affixing said second end adjacent to said opening around the entire periphery except one section thereby defining an aperture.

6. The method set forth in claim 5 further including the step of:

C) affixing along at least two longitudinal paths said folded inner tube portion together thereby defining at least two compartments.

7. The method set forth in claim 6 wherein said step of affixing said second end is interrupted for each of said compartments so that an aperture is defined for each of said compartments.

8. The method set forth in claim 7 further including the step of:

D) forming a turn welt prior to said step of forming an inner tube portion.

* * * * *